United States Patent [19]

Clasen et al.

[11] 4,259,024

[45] Mar. 31, 1981

[54] DEVICE FOR MIXING FLOWABLE MATERIALS

[75] Inventors: Heinrich Clasen, Gerstenbergstr. 34, 2000 Hamburg, Fed. Rep. of Germany; Sven Clasen, Lohof, Fed. Rep. of Germany

[73] Assignee: Heinrich Clasen, Hamburg, Fed. Rep. of Germany

[21] Appl. No.: 36,757

[22] Filed: May 7, 1979

[30] Foreign Application Priority Data

May 9, 1978 [DE] Fed. Rep. of Germany ..... 2820186

[51] Int. Cl.[3] ..... B01F 15/00

[52] U.S. Cl. ..... 366/339

[58] Field of Search ..... 366/336, 337, 338, 339, 366/340; 138/38, 42; 48/180 R, 180 B

[56] References Cited

U.S. PATENT DOCUMENTS

| | | | |
|---|---|---|---|
| Re. 28,072 | 7/1974 | Sluijters | 366/337 |
| 3,804,376 | 4/1974 | Clasen | 366/338 |
| 3,871,624 | 3/1975 | Huber | 366/336 |
| 3,942,765 | 3/1976 | Henrickson | 366/336 |

FOREIGN PATENT DOCUMENTS 2209601 12/1972 France .

*Primary Examiner*—Robert W. Jenkins

*Attorney, Agent, or Firm*—Montague & Ross

[57] ABSTRACT

A device for mixing flowable materials, especially relatively viscous liquids and flowable solids, comprises a pipe or tube section, preferably of circular cross section, provided internally with at least one mixing element helically twisted in a uniform manner about the axis of the pipe and formed with only two groups of surface regions which are folded relative to one another and which alternate along the mixing element. Each of these surface regions is of flat triangular outline with a base of the triangle formed along one of the helically twisted longitudinal edges of the mixing element and converging toward the other. The flat surface regions may be truncated, i.e. of generally trapezoidal outline with their narrow triangle side lying along the opposite edge of the mixing element from that occupied by the base, or of a pointed configuration where the triangle apex lies along this opposite side of the mixing element.

14 Claims, 8 Drawing Figures

DEVICE FOR MIXING FLOWABLE MATERIALS

FIELD OF THE INVENTION

The present invention relates to a device for mixing flowable materials and, more particularly, to a device which is capable of mixing viscous liquids and flowable solids as they pass through a pipe section, this device comprising a pipe section preferably of circular cross section formed internally with at least one mixing element.

BACKGROUND OF THE INVENTION

A device for mixing liquids and flowable solids while they tranverse a pipe section of, for example, circular cross section, can comprise a mixing element received within the pipe section and subdividing the flow of material into at least two streams while guiding them around and along a common axis.

Such a device can be formed from a flat sheet-metal blank which can be provided with generally flat surface regions of triangular outline.

The term "mixing element" as used herein is intended to refer to a static structure across which the stream to be mixed is passed, such element generally being provided in a fixed condition within a pipe through which the material is displaced, e.g. by a pump or other means.

The term "flowable material" is used herein in its most general sense to mean any fluid or flowable solid, although it is particularly intended to refer to materials which are difficult to mix and are relatively viscous. The nature of materials which may be treated with the system of the present invention will be detailed below, but it should be understood that the treatment may involve any conventional treatment which utilizes the movement of such flowable materials.

Thus the term may refer to homogenization, material exchange, heat exchange or a combination thereof whereby, for example, a flowable solid may be treated by a liquid, a liquid may be treated with a gas, a solid can be treated with a gas, or various heat exchange and material exchange or chemical reaction processes can occur with or within the flowable materials.

Thus in the instant description, the liquids and flowable solids to be mixed can be subjected to a process in which each particle or portion of the liquid or of the solid in the medium comes into contact with a surface of the device which guides the flow and which induces a rotary movement therein. The particles are also brought into contact with other particles of the liquid or the solids.

The mixing process of the present invention may thus also involve a heat exchange or an interchange of matter of interaction between the particles themselves or between the particles and fixed walls of the device, or between particles of the flowable material or layers arranged on or formed as part of the mixing device. For example, when the interchange is a catalytically induced chemical reaction, portions of the device may be constituted as a catalyst support.

The "mixing" can thus include kneading, emulsifying, dispersing, plasticizing or homogenizing a flowable mass thereby retaining or altering physical or chemical properties. The production of a uniform molecular weight in a flowable synthetic resin of liquid or particulate form is thus a mixing process in the sense of the present invention.

Furthermore, if the reaction involves a catalyst on a wall or pipe surface a mixing process nevertheless takes place in order to bring all of the particles of the flowable material into as uniform contact as possible with the catalyst as the streams traverse the pipe section.

The mixing can occur during polymerization, condensation, neutralization or reduction, during oxidation or hydration, during fermentation or like processes.

Layers of an adsorption agent, a grinding or polishing agent, or any other material-treatment agent may be provided on the surfaces of the device. A case in point is the dehusking of grain in which the flowable mass of grain, with husks or hulls thereon, is cause to traverse a device of the present invention in a uniform flow so that the grains of corn or rice, etc. are brought into uniform contact over their entire surfaces with solid grinding or abrading surfaces within the pipe section to carry out the treatment.

Devices utilizing the principles described above are known from various applications and mention may be made, for example, of German No. 3,861, No. 86,622 and No. 1,557,118. In these systems, for the purpose of heat exchange or to mix flowable materials it is known to provide several successive and oppositely twisted mixing elements in the form of short helically bent strips into a pipe or duct to internally subdivide the flow of fluid into two flow cross sections of uniform area.

The adjacent end edges of the successive elements are arranged at an angle with one another to repeatedly subdivide the streams and combine them.

Each flow cross section or stream thus can contain parts of the divided flows from the preceding mixing element.

It is also known (see German open application, Offenlegungsschrift, Nos. 2,205,371 and 2,320,741) to mix elements in the form of layers in contact with one another to form a multitude of flow channels. In this case, the longitudinal axes of the individual flow channels within each layer are parallel, at least in groups. The longitudinal axes of the flow channels of adjacent layers can be inclined to one another. Between the individual layers, exchange may occur between the respective streams of the flowable material through openings.

German Pat. No. 2,058,071 and U.S. patent No. 3,804,376 describe systems for locking mixing elements in a pipe more firmly into position and provide a configuration which enables these elements to be manufactured more easily. In these systems twisted strip elements are provided and have a slit for engagement with adjacent or successive strip elements.

Mention should also be made of French Pat. No. 2,209,601 which provides a pipe section with bent sheet-metal mixing elements. In these mixing elements, triangular flat sections are provided and the triangular surfaces or zones are of different shape and size with all of the triangle vertices terminating at a common point. Fold lines are provided between these triangular sections.

Experience has shown that the mixing elements of this French patent do not bring about a uniform splitting and rotation of the flow material over a significant axial length, especially because the hydraulic diameter of the flow cross sections traversed by the streams into which the mixing element splits the flow are not constant over the length of the mixing element.

Disadvantages also have been found with systems of the type described in the German printed application (Auslegeschrift) 1,557,118 mentioned briefly above.

In all mixing processes, the shearing action of the respective mixing element has been found to determine the success or efficiency of mixing as well as the effectiveness of the subdivision of the incoming stream of flowable material into flow parts or streamlets.

According to the type of loading, a change of shape and position of the folded layers of material which slide on one another can be achieved. The type and intensity of the loading is dependent on the respective constructions of the flow channel which is formed by the mixing elements built into the portion of the pipe through which the flowable material passes.

In known devices in which the individual flow cross sections are of semicircular configurations and constitute the partial flow channels, an unchanging ratio between separating and shearing action is obtained. This ratio remains substantially constant even with the change in the pitch of the mixing element. In such systems, if it is desired to increase the shearing action to provide a certain degree of shearing within a particular material, i.e. to match the desired properties of the material to the mixing device, it is necessary to increase or otherwise alter the number of mixing elements.

In practice, therefore, the devices of the prior art must be provided with numerous mixing elements and relatively long mixing paths. This is especially the case when the element can have the length of 1.25 to 1.5 times its diameter, such a length having been found to be convenient from the point of view of manufacture.

Difficulties have also been encountered in deforming the elements to form helically curved strips. These difficulties increase significantly as a result of extreme transfers and longitudinal distortions of the strip with increasing diameter. There is, therefore, a dependence between the thickness of the material and the diameter of the elements which can be fabricated therefrom. In twisting a conventional steel such as the V to A steel the thickness of the element must be about 0.075 times the diameter in order to avoid tearing or undesired deformation of the element upon helical twisting. This has been found to rule out largely the manufacture of such elements in large diameters from strip material. In practice one finds that it is necessary in manufacturing large diameter mixing elements, to apply casting techniques which are far more expensive and complex.

OBJECTS OF THE INVENTION

It is the principal object of the present invention to provide a device for mixing flowable material which avoids the difficulties, which is of simplified manufacture and which can be of relatively large diameter and inexpensive construction, Another object of the invention is to provide a device for the purposes described whose mixing elements can be fabricated with a relatively small length by comparison to the diameter without difficulty and without excessive cost.

Yet another object of the invention is to provide a mixing device with an improved mixing efficiency and effect and which facilitates matching of the material and the treatment desired to the dimensions of the mixing device and especially the shape of the mixing elements.

SUMMARY OF THE INVENTION

These objects and others which will become apparent hereinafter are attained, in accordance with the present invention, in a device for mixing flowable materials, namely fluids and flowable solids, which comprises a pipe section or duct preferably of circular cross section having at least one mixing element which subdivides the flow of material into two streams and rotates them about a common axis while inducing a mixing movement in each of the streams. The mixing element is fixed in the pipe section and is formed from a flat sheet-metal blank with successive substantially flat surface regions having fold lines betwen them and of triangular outline. Each of these surface regions has a convergence in the direction of one of the walls of the pipe and in the direction of one of the longitudinal edges of the helically twisted sheet-metal member.

According to the invention, the mixing element is curved helically in a uniform manner about the pipe axis and comprises only two groups of different surface regions which alternate with their convergences in opposite directions transverse to the pipe axis so that the vertex or narrow end of the generally triangular configuration of one surface region terminates along the longitudinal edge of the element opposite the longitudinal edge at which the base of the triangle terminates and at which the bases of two adjacent surface regions of the other group terminate.

According to a feature of the invention, the successive surface regions of opposite orientation are folded from a flat sheet-metal blank of rectangular outlint and the surface regions belonging to the same group each have the same inclination with respect to a plane containing the axis of the pipe and passing through a fold edge of the surface region and an adjacent surface region. Every second or other surface region can be provided in a plane containing the pipe axis, i.e. an axial plane, while the surface regions adjacent thereto are inclined with respect to the latter plane.

According to another feature of the invention, the surface regions lying in an axial plane extend from pipe wall to pipe wall while remaining in this plane whereas the surface regions therebetween and adjacent these axial-plane surface regions are inclined thereto and extend only between the axis of the pipe and the wall thereof.

Each mixing element can comprise at least two identical portions joined together along a straight-line edge in the pipe axis according to yet another feature of the invention with the joint edge forming the terminuses of the narrow triangle side of the intermediate surface regions mentioned previously.

In the latter case, narrow sides of the surface regions of one group, lying in the joint edge, can be smaller than the narrow sides of the surface regions of the other group pointing to the walls of the pipe. In this same embodiment, each portion of the mixing element can be folded out of a portion of an annular or circular flat sheet-metal disk.

Extensions of the two fold lines of the developed portion of the mixing element, limiting the surface region, can pass through the center of the sheet-metal disk with different spacings. In this device, moreover, the extensions of two fold lines limiting each surface region can pass through the center of the sheet-metal disk when the latter is unfolded so as to be flat but with the same spacing and on opposite sides.

Where all of the triangular surface regions are of the same shape and size, the surface regions have small angles of between 5° and 30° which are inclined toward the walls of the pipe and the planes of adjacent surface regions are inclined with respect to one another at an angle between 30° and 120° . Where the surface regions are of different size, the smaller surface regions can have small angles between 5° and 15° converging toward the walls of the pipe while the larger surface regions can have small angles between 15° and 45° converging toward the pipe axis. The surface regions of the two groups lie in planes which include angles between approximately 100° and 160° with one another. The thickness of the material or of the sheet metal can be significantly less than 0.075 times the diameter of the mixing element and advantageously the joint between portions of the mixing element can have a length which is smaller than the dimensions of the mixing element transverse to the joint edge.

In the new device of the present invention the shearing action is markedly improved because of the cascade-shaped and stepped configuration of the flow channel brought about by the particular alternate arrangement of the relatively inclined successive triangular regions with convergences in opposite directions, especially in relation to the subdivision into streams of the material.

This means that with the same length of a mixing element, the loading on the material flowing through the system is substantially greater in the system of the present invention so that a substantially more intense mixing action is achieved.

This enables the length of the mixing path to be kept small relative to the diameter of the mixing element and hence the overall length of the device to be relatively small. The device of the present invention permits fabrication of the mixing element without particular concern for the thickness of the material (see the disadvantages mentioned earlier) and, more particularly, permits the mixing elements to be fabricated from sheet metal even when large diameter mixing elements are used. It is an important advantage of the present invention that the thickness of the sheet metal can be significantly less than 0.075 times the diameter of the mixing element.

The pressure drop in the device and the losses due to congestion at the ends of the elements can be substantially reduced because of the increase in size of the flow cross sections into which the mixing elements subdivide the stream. In addition, a material can be used which is relatively more difficult to bend and is somewhat more rigid or less viscous. The result is a device whose rigidity is increased because of the configuration of the mixing element even with smaller thickness of the sheet-metal material.

In the device, a plurality of identical or similar mixing elements can be disposed one after the other in the direction of flow of the material and the elements can have their end edges in mutual contact. However, some mutual spacing may be provided between the ends of the successive elements and locking and orientation of the elements can be achieved by means of slits in the end portions which interfit. Such interconnection is known in the art as noted previously.

Usually the mixing element is closely encircled by the inner wall of a pipe or sleeve. Tolerances play no special role in the region of the peripheral edge of the mixing element and the inner wall of the pipe since clearances in this region do not not restrict the mixing action or the function of the new device. However, the mixing element can fit snugly and be entered in the pipe by any conventional means.

Since clearances are not a factor, the fabrication of the device can be facilitated and made less expensive and, indeed, manufacture of the mixing elements by casting is no longer required.

While it is preferred to fabricate the mixing elements by bending and folding from sheet metal in the manner described, of course, the mixing element can be produced from different materials and by other methods of manufacture. The fabrication from metal sheet has the significant advantage that the element can be folded, twisted and bent from flat sheet-metal blanks.

The mixing device of the present invention can also be used as a condenser or vaporizer for producing fuel mixtures and is particularly inportant as a device (aerator) for introducing oxygen from the air into waste water for its biological water treatment.

The cascaded flow channels of the system of the present invention can be constructed so that the cascaded steps or folds can extend transversely to the axis of the pipe from one side of the pipe wall to the opposite side thereof, i.e. diametrically across the pipe. Each mixing element can, however, comprise two elements running longitudinally parallel to the axis of the pipe so that the steps in each case run transversely from the axis of the pipe to the pipe wall. In either case, distortion-free fabrication is possible by by folding the unit form a flat metal sheet. The size of the triangular surface regions can be the same or different. In particular it is possible to vary the fold angle over the length of the given mixing element or from mixing element to mixing element so as to match a change in consistency of the flowable material which is processed.

The term "triangular surface region" is here used to refer to a surface region which is a perfect triangle, i.e. is made up of three sides joining at respective vertices and each of which lies along a straight line.

However, it also is intended to refer to surface regions in which the base, lying along one longitudinal edge of the mixing element is somewhat curved to conform to the helical curvature of the longitudinal edges of the mixing element while the opposite end of the triangle terminates not in the vertex but in the narrow side so that the surface region has the configuration generally of a slender trapezoid.

The mixing element of the present invention can be effected form a flat strip-shaped blank or from a sheet-metal disk.

When a strip-shaped blank is used, the longitudinal edges of the folded and twisting mixing element lie substantially along helices of a constant pitch and are constituted substantially from the triangle bases of the surfaces and narrow sides of trapezoidal surfaces.

Each substantially traingular surface can then extend over the entire width of the metal strip transverse to the axis. In each case, two adjoining triangular surfaces, oriented oppositely in the manner described, define an angle between them and constitute one of the cascade stages, the depths of which are determined by the triangular surfaces which are flatter relative to the longitudinal axis and the height of which is determined by the steeper triangular surfaces.

By selection of the size of the acute angle of the triangular surfaces, the step height and depth can be changed without changing the diameter of the helix and hence of the mixing element. This allows the mixing element to be adapted to the particular mixing requirements. In the transition between laboratory testing and practical application, the elements can easily be obtained by three-dimensional scale enlargement without changing the angle and without changing the outline shape of the triangular surfaces.

When the mixing element is fabricated from a disk, the longitudinal axis of the mixing element is simultaneously the joint edge for two identical sheet-metal portions which may be welded or otherwise bonded together. Helical longitudinal edges have a uniform pitch and are formed by narrow sides of the triangle. In each case, two oppositely oriented triangular surfaces of each portion of sheet metal which adjoin in a longitudinal direction form a step together. Each step constitutes one stage of the cascade.

By changing the size of the small angle, a finer or coarser step is obtained for matching to the particular mixing task. The larger the difference in area between the two triangular surfaces, the longer the element will be and vice versa. Here too a three-dimensional scale enlargement is possible when proceeding from laboratory testing to practical production. In both embodiments the height of the steps changes transversely to the axis of the mixing element. Thus an additional improvement in the transfer of heat is made possible by the additional turbulence induced at the steps. The turbulence thus arising combines with other turbulent or vortex swirls to form larger pairs of resistances which are again subdivided into smaller pairs of induced resistances. The system has been found to be particularly effective when matching to specific mixing requirements is required.

In contrast with known helical semi-circular channels using mixing elements from helically twisted strips, the elements of the present invention where the oppositely oriented triangular folds not only locate the flow about the hydraulic center of the flow channel, whereby the flow layers are curved concentrically about a center point, but induce multiple loading of the layers of flow which slide on one another in the region of the cascaded steps. The latter can have a different step height transverse to the axis of the pipe and step widths which also vary. The step heights and step widths change both radially and axially as seen by the advancing flow of the material. The shape and position of the layers and the layering is thus continually changing as a result of the differences in pair which are seen by the advancing stream. This facilitates optimum matching to the ratios required for a particular mixing process.

It is also possible, within the framework of the present invention to vary the parameters of construction of the device empirically and without particular difficulty for each particular job.

For example, the elements can vary in step number for a given incoming flow angle and, with a constant flow angle, one can change the step width and step depth. If the element has triangular surface regions of equal size then the income flow angle is 90° + half the angle of inclination. With elements formed from surface regions of different size, and incoming flow angle is the angle of inclination between the small and large surface regions. A change in step number for a constant incoming flow angle can be achieved by changing the size of the surface regions, or by changing the acute angle of the triangular outline, i.e. the angle of convergence toward a longitudinal edge of the mixing element. A change in the angle of fold between the adjacent surface regions also results in a change in the incoming flow angle. Moreover, with constant pitch twist of the element, the ratio of the length of the element to its diameter changes, for example, by 180°.

With elements made from differently sized triangular surface regions, the number of steps in the length of the elements determines the incoming flow angle and surface ratio between the large and small triangular surface regions determines the step depths and step widths. With very large differences small step numbers are provided with an incoming flow angle of almost 90° there is a very small element length. This can be less than half the diameter. The height of the steps is very low as a result and the step area or width is very large.

Because of the variation in the construction of the flow channel, the loading of the layers we slid on each other can be varied. This is particularly the case because of the zig-zag or cascade path over the longitudinal axis of the pipe resulting from the particular flow construction of the steps. This construction has been found to be particularly advantageous in the case of extreme differences in the viscosity of the fluids to be treated or to be mixed. The channel formation or straight through flow which has been feared in the case of large-diameter helical mixing elements in the past is simply absent. In folding the mixing elements, the stripped-form blanks or disks can be provided with left- and right-hand twists and folds as desired.

In order to vary the construction of the steps for modifying shearing action, certain steps can be filled with appropriate material. The filler can be anything which bonds to the sheet metal of the mixing elements. This filler also tends to increase the stability of the mixing element.

The surface of the mixing element can be coated with catalytically effective, absorbent, absorbent, grinding or polishing substances. In some cases the elements can themselves be formed unitarily from such substances. With laminated elements, the parts may be fixed to one another by welding, soldering or gluing, although preferably a formed or overlapping construction is provided with interlock seams.

BRIEF DESCRIPTION OF THE DRAWING

The above and other objects, features and advantages of the present invention will become more readily apparent from the following description of several embodiments thereof, reference being made to the accompanying drawing illustrating these embodiments in diagrammatic form. In the drawing.

SPECIFIC DESCRIPTION

Figures 1, 2, 3, 4, 5, 6, 7:
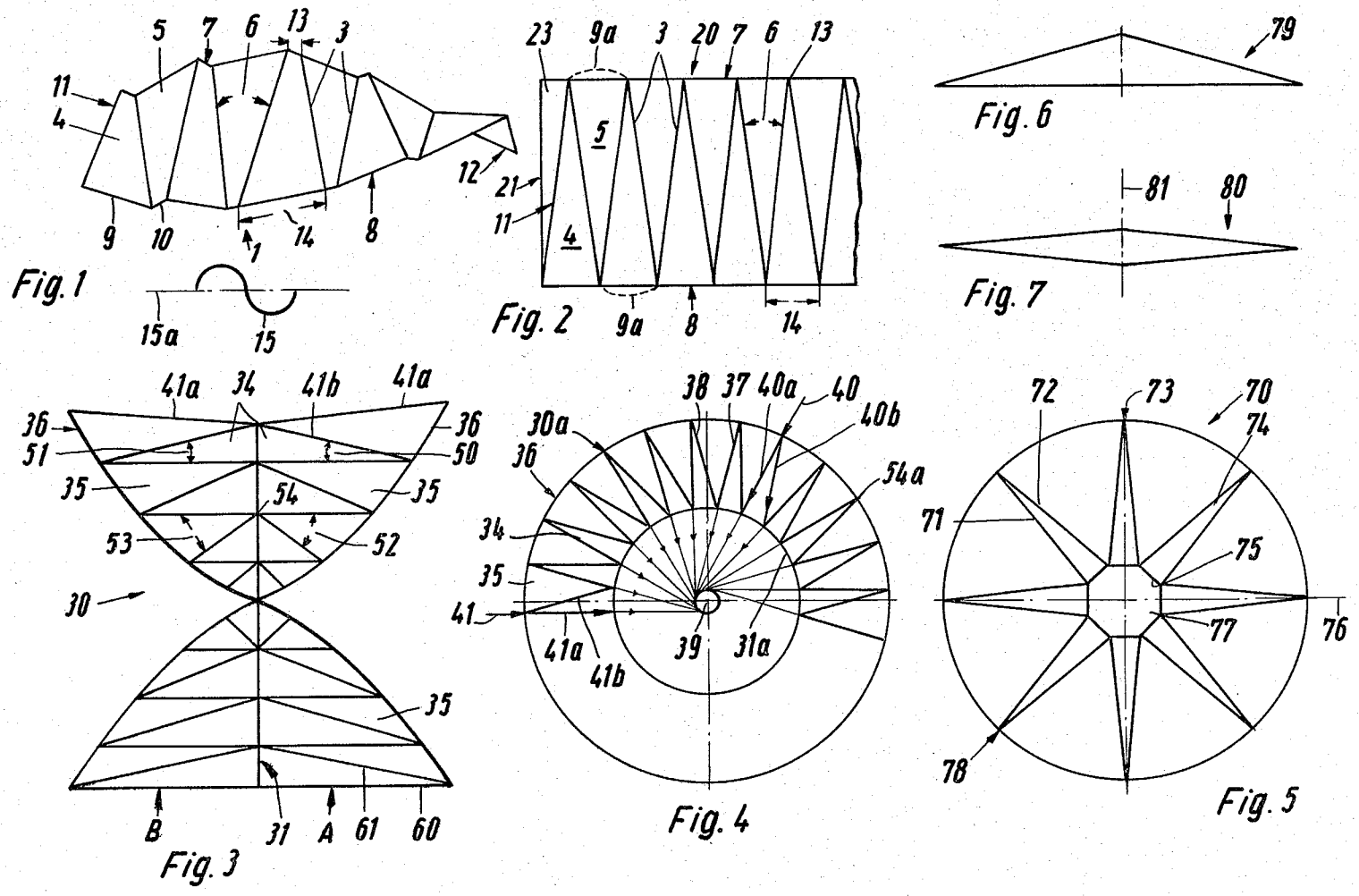
FIG. 1 is a perspective view showing a mixing element for insertion into a pipe section of a device in accordance with the invention.
FIG. 2 is a plan view of a strip-shaped blank from which an element of the type shown in FIG. 1 can be formed.
FIG. 3 is a side view of an element in accordance with a modification of the invention.
FIG. 4 is a plan view of an annular sheet-metal disk from which the mixing element of FIG. 3 can be fabricated.
FIG. 5 is a modification of the sheet-metal disk for producing another mixing element in plan view.
FIGS. 6 and 7 are elevational views showing different overlapping members which can be used to connect the halves of a mixing element formed in several parts.
Figure 1A:
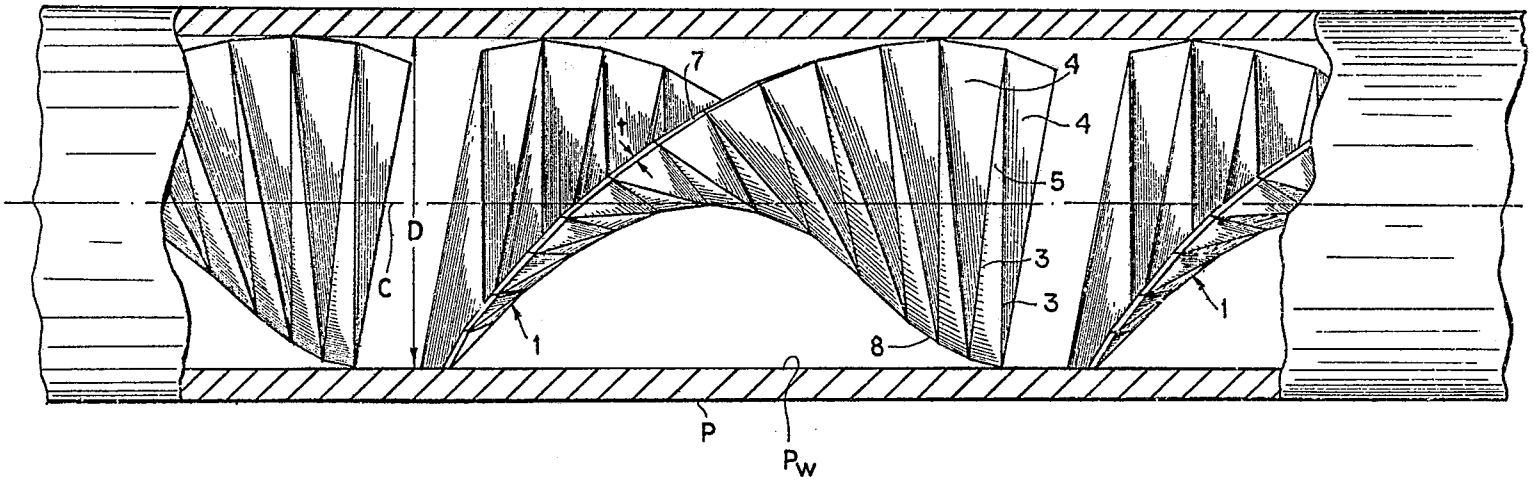
FIG. 1A is an elevational view, partly broken away, showing a pipe containing the mixing elements of the present invention and illustrating principles of the invention.

Referring first to FIG. 1A which illustrates the principles of the present invention, it can be seen that a pipe section P which can be used in a system of the type shown in German printed application (Auslegeschrift) No. 2,058,071 has an inner wall $P_w$ with an internal diameter D which is traversed in the direction of the axis C by a flow of viscous material to be mixed.

Within this pipe section there are provided a plurality of successive mixing elements 1 shown to be axially spaced upon although they can be connected by a slot construction as described in the German printed application referred to last above. Each of the mixing elements can have the configuration shown in greater detail in FIG. 1 and illustrated only in the most diagrammatical form in FIG. 1A.

Each of the mixing elements can be folded from sheet metal of a thickness t which is less than 0.075 times the diameter D.

The mixing element 1 shown in FIG. 1 can be produced by simple bending and folding of a flat strip-shaped sheet-metal blank 20, the bending being effected along fold lines 3.

The element thus has triangular surface regions 4 and 5 which are of equal size here and are connected to each other at the fold lines 3, but which are inclined with respect to one another in different planes.

The flat triangular surface regions 4 and 5 are oriented in opposite directions, transverse to the longitudinal direction of the mixing element 1. Thus the two longitudinal edges 7 and 8 of the mixing element are formed alternately with narrow sides 9 of triangular surface regions 4 and 5, forming the bases of the respective triangular regions, and vertices or truncated apices 10 of these surface elements.

The bases 9 can be formed on the straight longitudinal edges of the sheet-metal blank 20. However, in producing the sheet-metal blank, the narrow sides or bases 9 can also be outwardly convex as indicated by broken lines in FIG. 2 at 9*a*.

The apex angle of the vertex lying along the longitudinal edge 7 or 8 is designated at 6. The width of the narrow side of each triangular surface is designated 14 and the width of the truncated apex (forming the small base of a trapezoid) is designated at 13 in FIG. 1.

The front and rear end edges are shwon at 11 and 12.

Depending upon the size of the angle 6, the triangular regions are of large or small area. The triangular surface regions are curved by forming cascade-shaped steps in a zig-zag configuration at the fold lines, the folding taking place so that the element is twisted at the same time about its longitudinal center line or its longitudinal axis which corresponds to the longitudinal axis of the pipe. The twist may either be in the left-hand sense or in the right-hand sense depending upon the direction of folding.

As has previously been described in connection with FIG. 1A, the mixing element is usually received in a pipe section so that the clear inside diameter D of the pipe corresponds substantially to the width of the sheet-metal element.

As seen from the twist axis of the element, the height of the steps changes according to the longitudinal edges 7 and 8. A zig-zag path of the longitudinal edges is formed by cutoff apices 10. If the apices are not cut off or truncated, then a smooth helical path of the longitudinal edges is assured, these edges being formed only by the bases of the triangular regions.

The twisting of the element is represented at 15 in FIG. 1 schematically and is shown to be helical about the longitudinal axis 15*a* of the element, this longitudinal axis coinciding with the axis of the pipe.

In the embodiment illustrated in FIG. 1, the end edges 11 are inclined to the pipe axis. If one would have cut the triangular regions 4 and 5 which enjoin the end edges along the respective angle 6 so as to bisect the latter, the end edges would run perpendicular to the pipe axis as is possible in accordance with another embodiment of the invention.

Even where relatively thin materials are used for making the sheet-metal elements of FIG. 1, there is a high degree of rigidity and stability of shape because of the zig-zag configuration and cascade formation of the steps. Coatings thus can be anchored effectively to the surfaces which are inclined to one another.

The blank 20 of FIG. 2 has an end element forming the edge 21, as shown at 23, so that the edge, upon twisting, will run perpendicular to the pipe axis.

The mixing element shown in FIG. 3 at 30 is constituted of two halves A and B joined together along the axis 31 of the mixing element, e.g. by welding, overlap joints or interlocking seams.

Each of the mixing element halves or portions have triangular surface regions 34 and 35 which are folded and converge in opposite directions in the manner previously described and alternating with one another.

The triangular surface regions 34 abut in the region of the element axis 31 at their triangular bases while the surface regions 35 terminate at this axis with their apices 54.

The surface regions 34 each lie in pairs in a common plane while surface regions 35 of the two halves A and B lie in different planes. The apex angles 50, 51 of surface regions 34 are of the same size while the apex angles 52, 53 of the surface regions 35 are also of the same size.

The halves A and B are in each case formed from a flat annular sheet-metal disk portion 36 and assembled in mirror image along their longitudinal axis 31.

The end edges of the elements can be of different construction. The lower end edge 60 is here shown to be arranged at right angles to the element axis 31. If a cut were made at the lower region of the element along the triangular edges then at the lower end an obtuse angle would be seen. At the upper end of the embodiment of FIG. 3, this obtuse angle is shown to be formed by the edges 41*a*. If a cut were taken along the edges 41*b*, therefore, it would be a reflex angle of the two end edge regions.

The sheet-metal disk shown in FIG. 4 has fold lines 37 and 38 so oriented that fold lines 37 on the disk are tangential to a small diameter circle, i.e. run past, at a small spacing, one side of the center of the disk 39. The fold lines 38 on the opposite side run past at a larger spacing.

The sheet-metal disk is cut through at 40 and 41 along fold lines 40*a* and 40*b* or along fold lines 41*a* or 41*b*, respectively, according to the desired orientation of the end edges of the element in FIG. 3.

The inner edge 31*a* of the annular sheet-metal disk is then stretched out during folding of the sheet-metal disk portion along the fold lines 37, 38 into a straight line which coincides with the element axis 31. The two element halves A and B are connected along this inner edge by means of soldering, welding, gluing or, preferably, by means of the overlapping connection previously described. Thus inside the disk, triangular extensions can be attached to the edges 31*a* which are pushed over the smaller of the triangle portions 34 to the other half and in the same plane therewith. A particularly firm connection of the two halves of the element can be effected by means of these overlapping portions.

However, separate overlapping portions may be provided as shown in 79 and 80 in FIGS. 6 and 7, these being matched to the triangular surface portions lying in the same plane and overlapping two related triangular portions of the element halves A and B. The overlapping portion in FIG. 6 serves to connect the element halves as shown in FIG. 3 while in FIG. 7 an overlapping part is shown which can be used with mixing elements fabricated from the modifying disk illustrated in FIG. 1.

In the embodiment of FIG. 4 the central circle which is produced by the tangential orientation of extensions of the fold lines 37, has its diameter so selected that it is equal in length to the narrow side 31*a* of the smaller triangular surface regions 34.

Folding along the fold lines is effected so that the element halves are twisted about the common axis 31 and thus define cascade-shaped stepped and coiled flow paths.

The larger the ratio between the angles 50, 51 on the one hand and 52, 53 on the other hand, the shorter will be the entire element. The surface elements of different size thus form steps with step depths corresponding to the expanse of the smaller triangular surface regions.

The step depth decreases from the element axis 31 to the longitudinal edge 36. The step area is determined by the element of the large triangles. This area increases from the element area axis 31 to the longitudinal edges 36. Large surface regions that lie adjacent to each other and belong to the two series A and B, lie in different planes and therefore are rotated with respect to one another.

The disk of FIG. 5 provides an extreme surface ratio between a smaller triangle and large triangle as can readily be seen.

The fold lines 71 and 72 run past the center of the disk on both sides of it at equal spacings so that the angle bisectors 74 of the small triangle pass through the center of the disk.

The inner opening of the annular disk is here polygonal with an edge length 75 corresponding to the base of the smaller triangle. The separation through the annular disk is effected at 76 and at 78. The central opening has been shown at 77.

From the small length of the narrow sides 75 it can be seen that an element of very small length can be obtained relative to the diameter. Here too, after separation, zig-zag folding is effected with twisting and two identical elements are assembled in mirror-symmetrical relationship along the element axis, e.g. where the overlapping elements are shown at 80 in FIG. 7. The resulting mixing element thus has an incoming flow angle which is approximately 180° and is equal to the fold angle. The element length corresponds to 0.39 times its diameter. The angle of increase of the element amounts to 72° with the element having four stages containing five large and five small surface regions.

Because of the different inclinations of the end regions and a different edge path of the two edges of each element, different loads may arise on the material, different loadings resulting also depending upon the direction of flow of the material across the mixing element. Another element may be provided which is rotated through 180° about the axis of the device from the first. This has been found to be desirable for the element fabricated from the disk of FIG. 4.

In the element fabricated from the disk of FIG. 5, there are identical incoming flow ratios from either side of the device. By joining the inner edges of several element parts in a star configuration, more than two flow channels extending over the length of the elements can be obtained and the element parts can be mutually offset along the element axis.

We claim:

1. In a device for mixing a flowable material wherein the flowable material is passed through a pipe section provided with at least one mixing element subdividing the flow of the material into at least two streams and guiding the streams around a common axis, each mixing element being formed from a flat sheet metal blank with successive substantially flat surface regions of triangular outline, the improvement wherein the mixing element is curved helically in a uniform manner about the axis of the pipe section and comprises only two groups of flat surface regions of oblong triangular outline, the regions being oriented alternately in opposite directions transverse to said axis and being folded angularly relative to one another along common long sides of the respective triangles, the smallest triangle side of the flat surface regions of one group lying along one helical longitudinal edge of the mixing element and the triangle apices of the other group lying along said longitudinal edge between said smallest triangle sides of adjacent surface regions of said one group.

2. The improvement defined in claim 1 wherein successive smallest triangle sides and alternating triangle apices form an uninterrupted helical longitudinal edge of the mixing element.

3. The improvement defined in claim 1 wherein successive surface regions of opposite orientation are folded from a flat sheet metal blank of rectangular outline.

4. The improvement defined in claim 1 wherein the surface regions of the same group each have the same inclination with respect to a plane containing the axis of the pipe and passing through a fold edge between adjacent surface regions.

5. The improvement defined in claim 4 wherein the flat surface regions of one group are disposed in a plane containing the pipe axis and the flat surface regions of the other group inclined relative to the plane containing the pipe axis.

6. The improvement defined in claim 5 wherein the surface regions lying in a plane containing the pipe axis extend between diametrically opposite regions of the inner wall of the pipe while remaining in the same plane while surface regions therebetween extend only between the axis of the pipe and the wall thereof.

7. The improvement defined in claim 5 wherein said mixing element comprises at least two identically formed sheet metal portions joined together along a straight line disposed substantially along said axis, each of said portions having an uninterrupted straight joined edge comprising alternately the smallest triangle side of the flat surface regions of one group and the apices of the flat surface regions of the other group.

8. The improvement defined in claim 1 wherein each of said portions is folded from a section of an annular flat sheet metal disk.

9. The improvement defined in claim 8 wherein extensions of fold lines defining said triangular portions, upon development of the respective portion, pass the center of the disk at different spacings therefrom.

10. The improvement defined in claim 8 wherein extensions of the fold lines delineating each each surface region, upon development of the respective portion, pass the center of the disk at the same spacing but on opposite sides.

11. The improvement defined in claim 7 wherein the length of the joined edge between said portion is smaller than the diameter of the mixing element.

12. The improvement defined in claim 1 wherein all of the triangular surface regions of the mixing element are of the same shape and size, each of said surface regions having a convergency formed between respective fold lines with angles between 5° and 30° turned toward the wall of the pipe, the planes of adjacent surface regions being inclined to one another at angles between 30° and 120°.

13. The improvement defined in claim 1 wherein said surface regions have different sizes, the smaller surface regions having included angles between respective fold lines of 5° to 15° furned toward the pipe wall and the larger surface regions having included angles between the fold lines between 15° and 45° turned toward said axes, adjacent surface regions lying in planes including an angle between approximately 100° and 160° between them.

14. The improvement defined in claim 1 wherein the thickness of the material from which said element is formed is substantially smaller than 0.075 times the diameter of the element.

* * * * *